US006931804B2

(12) United States Patent
Trarup et al.

(10) Patent No.: US 6,931,804 B2
(45) Date of Patent: Aug. 23, 2005

(54) PREFABRICATED SHEARWALL HAVING IMPROVED STRUCTURAL CHARACTERISTICS

(75) Inventors: Glenn M. Trarup, White Rock (CA); Thomas V. Leung, Vancouver (CA); George Shahnazarian, Burnaby (CA)

(73) Assignee: Shear Force Wall Systems Inc., Abbotsford (CA)

( * ) Notice: Subject to any disclaimer, the term of this patent is extended or adjusted under 35 U.S.C. 154(b) by 64 days.

(21) Appl. No.: 10/175,227

(22) Filed: Jun. 20, 2002

(65) Prior Publication Data

US 2003/0009964 A1 Jan. 16, 2003

Related U.S. Application Data

(60) Provisional application No. 60/299,471, filed on Jun. 21, 2001.

(51) Int. Cl.[7] ..... E02D 27/34; E04C 5/12

(52) U.S. Cl. ..... 52/295; 52/293.3; 52/167.3; 52/274; 52/693

(58) Field of Search ..... 52/167.1–167.3, 52/238.1, 274, 285.2, 293.3, 295, 481.1, 657, 693, 695, 713–714, 284, 202, 477–499, 764–765, 514, 790.1, 800.18, 800.12

(56) References Cited

U.S. PATENT DOCUMENTS

| | | | | |
|---|---|---|---|---|
| 3,691,712 A | | 9/1972 | Bowling et al. | |
| 4,005,556 A | * | 2/1977 | Tuomi | 52/93.2 |
| 5,072,570 A | | 12/1991 | Johnson | |
| 5,249,404 A | | 10/1993 | Leek et al. | |
| 5,533,307 A | | 7/1996 | Tsai et al. | |
| 5,617,693 A | | 4/1997 | Hefner | |
| 5,630,298 A | | 5/1997 | Tsai et al. | |
| 5,657,606 A | * | 8/1997 | Ressel et al. | 52/690 |
| 5,660,007 A | | 8/1997 | Hu et al. | |
| 5,706,626 A | * | 1/1998 | Mueller | 52/800.12 |
| 5,845,438 A | | 12/1998 | Haskell | |
| 5,904,025 A | | 5/1999 | Bass et al. | |
| 5,915,676 A | | 6/1999 | Abiru et al. | |
| 6,018,917 A | * | 2/2000 | Leek | 52/250 |
| 6,047,503 A | | 4/2000 | Kost | |
| 6,158,184 A | | 12/2000 | Timmerman, Sr. et al. | |
| 6,170,202 B1 | | 1/2001 | Davoodi et al. | |
| 6,185,898 B1 | * | 2/2001 | Pratt | 52/657 |
| 6,240,695 B1 | * | 6/2001 | Karalic et al. | 52/690 |
| 6,244,004 B1 | | 6/2001 | Timmerman, Sr. et al. | |
| 6,247,275 B1 | | 6/2001 | Taylor | |
| 6,308,469 B1 | * | 10/2001 | Leung | 52/167.3 |
| 6,453,634 B1 | * | 9/2002 | Pryor | 52/713 |
| 6,460,297 B1 | * | 10/2002 | Bonds et al. | 52/79.1 |
| 6,513,290 B2 | * | 2/2003 | Leek | 52/295 |

* cited by examiner

*Primary Examiner*—Winnie Yip
(74) *Attorney, Agent, or Firm*—Banner & Witcoff, Ltd.

(57) ABSTRACT

A novel prefabricated shearwall is disclosed with improved structural characteristics in terms of its ability to 1) transfer lateral loads to the foundation, 2) resist bending moments normally arising in conventional shearwalls between hold-down hardware and end posts or vertical framing members, 3) effectively diffuse stresses known to result in nail fatigue, and 4) reduce slippage between the bottom of the end posts and base in response to cyclic loadings. These superior properties result partly from its geometry in lower, or shear force transfer region, accompanied by thrust block/anchor rod assemblies to provide stiffness and strength over the lower portion of the end posts. Furthermore, specialized wrap-around connector plates that cover a portion of the bottom surface of these end posts also contribute to the enhanced prefabricated shearwall design.

28 Claims, 5 Drawing Sheets

PREFABRICATED SHEARWALL HAVING IMPROVED STRUCTURAL CHARACTERISTICS

CROSS-REFERENCE TO RELATED APPLICATION

This application claims priority from Provisional Application Ser. No. 60/299,471 filed Jun. 21, 2001, the contents of which are hereby incorporated by reference.

FIELD OF THE INVENTION

The present invention relates to a novel shearwall exhibiting superior structural characteristics. More specifically, the present invention relates to a shearwall with an upper region having ductile properties to dissipate seismic energy and a lower region having improved strength and stiffness properties to resist lateral loads.

BACKGROUND OF THE INVENTION

A shearwall is a common structural component of buildings, especially wood frame buildings, that is specifically designed to resist lateral forces due to wind and seismic loads. Typically, shearwalls are constructed on site using plywood or oriented strand board (OSB) sheathing nailed to dimensional lumber studs (e.g., "two by" boards) and plates, together with special hardware connecting the shearwall to the foundation to resist uplift forces.

For conventionally framed wood shearwalls, the structural behavior is well documented and understood. In fact, recent data obtained from the research and testing of such shearwalls has been incorporated into the latest building codes. Current testing procedures are based on protocols requiring that shearwalls be evaluated under cyclic load conditions. During this testing, shear strength and stiffness are determined by subjecting a wall assembly to full-reversal cyclic racking shear loads. The methodology entails anchoring the bottom edge of the wall assembly to a rigid base and applying a force or displacement parallel to the top of the wall. As the wall assembly is racked to specified displacement increments in the plane of the wall, the magnitude of the applied shear force is continuously measured.

The typical failure mode of conventionally framed shearwalls subjected to cyclic loading is characterized as fatigue failure of the nails or other fasteners at the bottom corners of the wall assembly. Thus, the connection between the sheathing and the framing members at this critical location is compromised, resulting in a significant loss of shearwall strength and stiffness. From these observations, shear stresses are concentrated at the bottom corners of the shearwall, so that the connections in these areas are critical to the performance of the shearwall.

Another problem that exists with conventional rectangular shearwalls is their incorporation of commercially available hold-down hardware that is bolted, screwed, or nailed to the bottom portion of the vertical perimeter members. This hold-down hardware is designed to resist the large uplift forces generated at the ends of a shearwall. Such hardware is connected to the foundation with anchor bolts that are necessarily offset to some extent from the vertical members that are being secured. Normally, the hold-down hardware is mounted to the vertical members, and directionally toward the inside of the end post. Due to the eccentricity or offset of the hold-down hardware relative to the centerline of the vertical members, bending moments are created. These bending moments cause increased stresses in the joints between the vertical and lower horizontal member (or base), thereby reducing the capacity of a conventionally framed shearwall.

In resisting various types of stresses encountered in their normal use, shearwalls must exhibit sufficient ductility, a property related to their inherent ability to dissipate seismic energy. For wood framed shearwall structures, building codes allow for a reduction in seismic loads, recognizing that wood shearwalls dissipate seismic energy. A recent development related particularly to the wood frame construction industry is the introduction of prefabricated shearwalls, which are assembled in a manufacturing plant and shipped to construction sites.

One advantage of prefabrication is the ability to incorporate features that strengthen the shearwall assembly, resulting in significantly higher lateral load carrying capacity compared to site built, or conventionally framed, shearwalls of similar dimensions. However, there remains a present need in the art to optimize prefabricated shearwalls in terms of their strength and ductility characteristics.

SUMMARY OF THE INVENTION

The present invention has incorporated a number of features into a prefabricated shearwall that provide exceptional structural performance compared to site-built or even prefabricated shearwalls of the prior art. One favorable aspect of the present invention is that it provides a shearwall with variable stiffness along the height of the wall. In particular, the prefabricated shearwall of the present invention possesses the desired ductility of a conventionally framed shearwall while it simultaneously provides increased strength, along with the substantial elimination of detrimental bending moments, in the base. Furthermore, the shearwall is sheathed with plywood or OSB that is structurally reinforced in areas most susceptible to failure. Overall, the combination of a ductile upper portion of the shearwall with a stiffened lower portion results in significantly improved seismic energy dissipation characteristics, while enhancing resistance to shear forces, when compared to conventional shearwalls.

The shearwall may include one or more diagonal framing members in the lower section that can transfer shear forces acting at the top of the wall to the foundation, thereby improving lateral load capacity. In securing the shearwall to the underlying foundation, one or more thrust block/anchor rod assemblies may be incorporated adjacent to each of the two vertical end posts, also referred to as vertical members or, more generally, supporting vertical members. Such an arrangement can 1) substantially reduce or even eliminate bending moments associated with conventional hold-down hardware and 2) redirect and distribute stresses from the bottom corners of the shearwall to other areas.

Additionally, the use of steel straps in predetermined areas can distribute shear stresses from highly stressed, to lower stressed nails, thereby substantially reducing or even eliminating nail fatigue. Furthermore, specialized 3-sided connector plates, where one side of each plate wraps around the bottom surface of each vertical member or end post, can be used to serve at least two functions. Namely, in response to an uplift or tensioning stress at the bottom of the end post, the relative movement between the lower horizontal member or base plate and the end post may be greatly reduced. In response to the opposite stress, compression, the stress load may be distributed over a larger area compared to the distribution achieved with traditional 2-sided connector plates that cover only a portion of the exterior sides, but not the bottom face of the end posts. All of these advantages are more completely discussed, with specific reference to drawings where appropriate, in the detailed description.

Accordingly, in one embodiment the present invention is a shearwall having improved resistance to lateral loads and comprising a first and a second supporting vertical member for supporting the shearwall in an upright position. The shearwall further comprises a base attached to the supporting vertical members, where the base and supporting vertical members define an area within a frame. The shearwall further comprises a horizontal dividing structure that, when the shearwall is supported in an upright position, extends substantially horizontally between each of the supporting vertical members at a height that is from about one tenth to about one half of the height of the shearwall, whereby the horizontal dividing structure divides the area within the frame into an upper region and a lower region, the upper region being greater than the lower region. The shearwall can further comprise a frame support structure extending between the horizontal dividing structure and the base for transferring shear forces to the foundation.

In another embodiment, the present invention is a shearwall having improved resistance to lateral loads and comprising a first and a second supporting vertical member for supporting the shearwall in an upright position. The shearwall further comprises a base attached to the supporting vertical members, where the base and supporting vertical members define an area within a frame. The shearwall further comprises an uplift force resisting system to transfer uplift forces to the foundation, the uplift force resisting system extending along the length of, and proximate, at least a portion of at least one of the supporting vertical members.

DETAILED DESCRIPTION OF THE INVENTION

Figure 1:
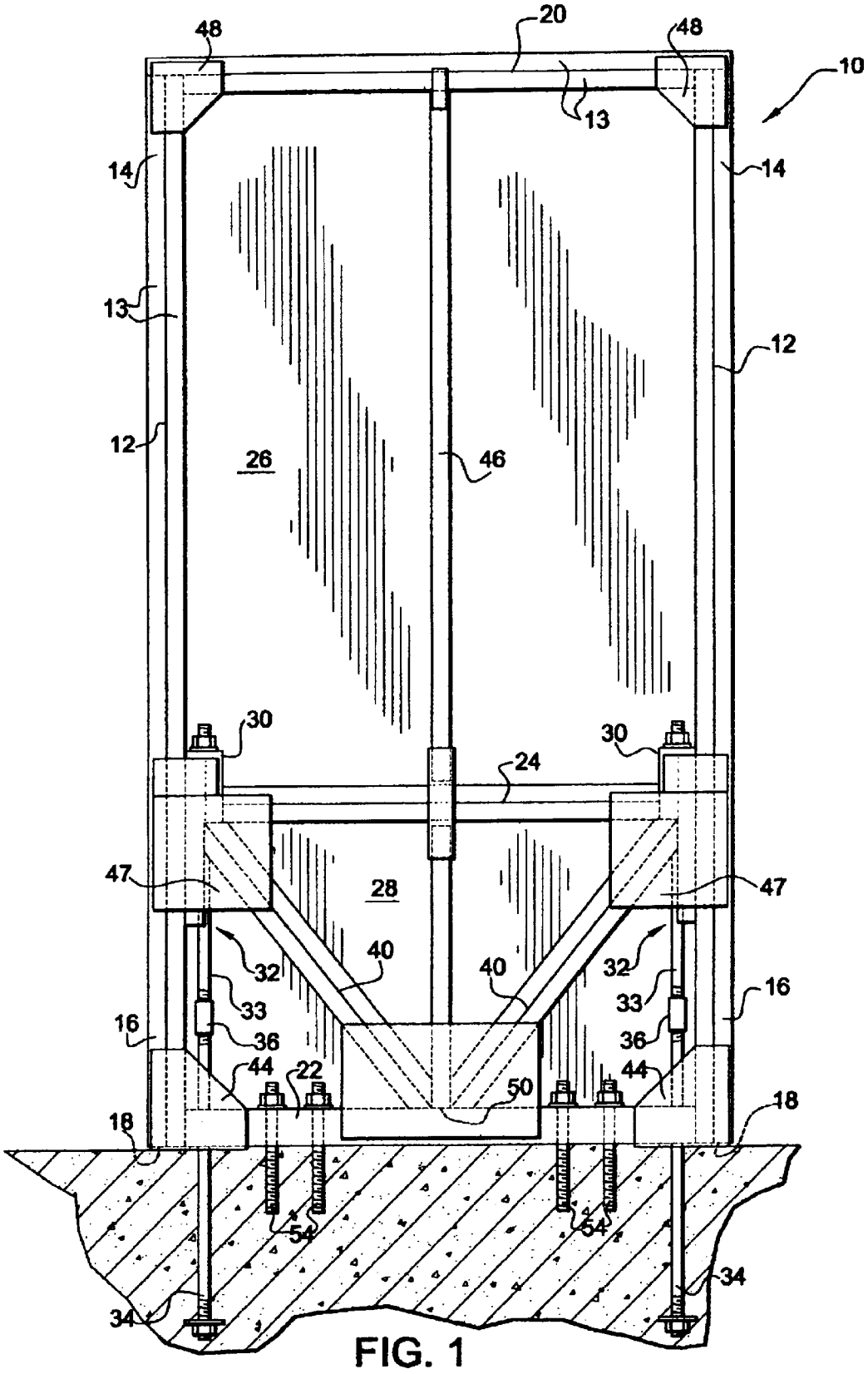
FIG. 1 is a front view showing a type of shearwall of the present invention, including the thrust block/anchor rod assembly as well as the geometry of the lower shear force transfer region.

A front view of a prefabricated shearwall according to the present invention is shown in FIG. 1. The prefabricated shearwall 10 has spaced apart supporting substantially vertical members 12 that may each comprise, for example, one or more boards 13 of dimensional lumber. Individual boards 13 forming each vertical member 12 may be positioned adjacent one another and secured together in any conventional manner using, for example, glue, nails, screws, bolts, and the like, or may be unsecured. In general, supporting vertical members can include boards, posts, or other elongated structures used to support a shearwall secured to a foundation in a substantially vertical alignment, where the plane of the shearwall is substantially vertical or perpendicular to the foundation. The perpendicular plane of the shearwall may contain a rectangularly shaped frame structure having vertical members, such as the shearwall depicted in FIG. 1. Alternatively, the perpendicular plane of the shearwall may contain a triangularly shaped frame structure having vertical members, such as in an A-frame. Otherwise, the perpendicular plane may contain further structures where the angle formed between the vertical member and a lower horizontal member or base, attached to the vertical member either directly or indirectly, is not necessarily a right angle.

In the specific embodiment of the present invention illustrated in FIG. 1, the vertical members 12 comprise two individual boards 13. Also, the vertical members 12 have upper 14 and lower 16 ends, with the lower ends 14 having bottom surfaces 18, preferably flat, for supporting the shearwall 10 in the upright position. In FIG. 1, where a rectangular-framed prefabricated shearwall is shown, upper horizontal member 20 and lower horizontal member 22 complete the rectangular frame. These members 20, 22 extend between the vertical members 12 and are secured thereto at both the upper ends 14 of the vertical members 12 and the lower ends 16 of the vertical members 12, respectively. The lower horizontal member 22 may also be considered the base of the shearwall. As shown in the specific embodiment represented by FIG. 1, the upper horizontal member 20 may comprise two individual boards 13, with one of these covering the tops of the vertical members 12 and the second extending only to the inside faces of the vertical members 12. Alternatively, both individual boards 13 may extend to the inside faces of the vertical members 12 or both may cover the top ends of the vertical members 12. These possibilities similarly apply to other junctions that make up the shearwall, where members comprising two or more individual boards are joined.

Because the frame is 3-dimensional, and preferably comprises dimensional lumber such as "2-by" lumber having a thickness of about 1½ inches, the frame dimensions define a rectangular prism having front and back faces. A further element of the shearwall 10 is a horizontal dividing member 24 that extends between the vertical members 12 and is secured to these vertical members 12 at a point along their vertical lengths near or below their respective midpoints, so that the horizontal dividing member 24 is positioned about half-way along the length of the shearwall 10, or in the lower half of the shearwall 10. In a preferred embodiment, the horizontal dividing member is positioned at a height from about one tenth to less than about one half the height of the shearwall. In another embodiment, the horizontal dividing member 24 is located at a position in the lower third of the shearwall 10, as shown in FIG. 1. In still other embodiments, the horizontal dividing member could be positioned at about one fourth or at about one half the height of the shearwall or at any position between these heights.

The horizontal dividing member 24 may be formed of dimensional lumber, metal, plastic, ceramic, or a like material capable of being secured to the vertical members 12 in any conventional manner. The horizontal dividing member 24 may have a rectangular or other cross sectional shape, such as a circle. In the latter case, a solid rod, a tube filled with material such as cement, or hollow tube may be used. As shown in FIG. 1, the connection between the horizontal dividing member 24 and the vertical members 12 can be accomplished using metal connector plates 48 affixed to the horizontal dividing member 24 and vertical members 12 with the use of, for example, nails, screws, bolts, brackets, clips, staples, glue, wood joints, or threaded, grooved, or slotted fittings, or by any other conventional manner. As an alternative to using metal connector plates 48, sections of plywood, plastic, resin, or other material may be used between the horizontal dividing member 24 and vertical members 12 to provide an indirect connection, where the horizontal dividing member 24 does not physically contact the vertical members 12. Of course, a direct connection is also possible, with or without the connector plates 48, such that a connection between horizontal dividing member 24 and the vertical members 12 is maintained by nailing, screwing, bolting, bracketing, clipping, stapling, gluing, or using wood joints, threaded fittings, or grooved or slotted fittings, or by any other conventional manner. When using slots or grooves compatible with members to be joined, a possible decrease in the structural integrity of the members, as a result of forming connecting surfaces out of the members themselves, should be considered. As described above, the horizontal dividing member 24 may include other devices to provide a direct or indirect connection with the frame of the shearwall 10. Also, the horizontal dividing member 24 may be referred to more generally as a horizontal dividing structure.

The horizontal dividing member 24 divides the shearwall 10 into two distinct regions. The upper, or energy dissipation, region 26 provides necessary ductility to the shearwall structure and thus allows it to dissipate seismic energy. The lower, or shear force transfer, region 28 promotes strength and stiffness, and also transfers loads, acting on the top of the shearwall 10, into the foundation. Generally, the upper, energy dissipation 26 region is a larger, or major region while the lower, shear force transfer region 28 is a smaller or minor region in comparison. When the horizontal dividing member 24 is positioned at about ⅓ the height of the vertical members 12, as shown in FIG. 1, the energy dissipation region 26 is about twice as large as the shear force transfer region 28. This configuration has been found advantageous in terms of both the resulting ductility of the upper region 26 of the shearwall 10 for energy dissipation as well as the stiffness and strength of the lower region 28 for resisting tension/compression stresses as well as bending moments. In a preferred embodiment, the use of connector plates 48 for either direct or indirect connections between the upper horizontal member 20 and vertical members 12 is desired for reinforcement of these junctions.

The lower or shear force transfer region 28 of the prefabricated sidewall 10 is characterized as having at least one diagonal framing member 40 that may comprise, in a similar manner to the vertical 12 and horizontal members 20, 22, one or more wooden boards, preferably characterized as "2-by" dimensional lumber. In FIG. 1, a preferred embodiment is shown, where two framing members 40 extending diagonally are used, with each of these diagonal framing member 40 attached at one end to the lower horizontal member 22 at approximately its midpoint 50. The opposite end of a diagonal framing member 40 can then be attached to either the closest vertical member 12, the horizontal dividing member 24, or both. As illustrated, the framing members 40 are not entirely horizontal or vertical, but extend at some angle relative to the base or lower horizontal member 22 such that they are capable of transferring laterally directed shear forces, acting on the top of the shearwall, 10 into the foundation. Transfer of force occurs due to the presence of a component of a laterally directed shear force in the direction in which the diagonal framing member 40 extends. This allows transfer of at least a portion of the laterally directed shear force along the length of the diagonal framing member 40 towards the lower horizontal member 22 or base, and further into the foundation. Preferably, as shown in FIG. 1, two diagonal framing members 40 are each used to connect the diagonally opposite vertices, where one vertex is represented by the midpoint 50 of the lower horizontal member 22, and the other vertex is represented by the intersection of the horizontal dividing member 24 with one of the two vertical members 12. In this embodiment, therefore, the first and second diagonal framing members 40 will each be secured or attached, at the end that is opposite the point of attachment to about the midpoint 50 of the lower horizontal member 22, to both the horizontal dividing member 24 and one of the vertical members 12.

The attachment of diagonal framing members 40 may be accomplished in any manner including, as shown in FIG. 1, the use of thrust block connector plates 47 to attach both sides of the diagonal framing members 40. It is not necessary for the diagonal framing members 40 to physically contact the horizontal dividing member 24 or vertical members 12 when, for example, a thrust block connector plate 47 provides a connection between these members. Otherwise, the diagonal framing members 40 may also be directly or indirectly attached to vertical members 12 and the horizontal dividing member 24, or to intermediary structures (e.g., a thrust block connector plate 47) by nailing, screwing, bolting, bracketing, clipping, stapling, gluing, or using wood joints, threaded fittings, or grooved or slotted fittings, or by any conventional manner. The diagonal framing members 40 comprise a frame support structure that extends between the horizontal dividing structure, which includes the horizontal dividing member 24, and the lower horizontal member 22 or base of the shearwall 10. This frame support structure may or may not include direct and/or indirect securing devices as described above.

Overall, the geometry of the diagonal framing members 40 and their positioning relative to the vertical 12 horizontal 20, 22, and dividing 24 members in the lower shear force transfer region 28 of the shearwall 10 have been developed to eliminate failure from nail fatigue at the bottom corners of the shearwall 10. These bottom corner locations are areas of local stress concentrations that are known to cause difficulties in the normal use of the shearwall 10. To mitigate such stresses, the diagonal framing members 40, via axial loads, transmit shear forces collected at the top of the shearwall 10 to the foundation. The component of any laterally directed force that is in the direction of the diagonal framing members will act on these members, allowing a transfer of this component of force to occur. Thus, the shear force transfer region 28 of the shearwall 10 of the present invention provides the shearwall 10 with significantly higher lateral load capacities compared to those associated with conventional shearwalls.

Another feature of the prefabricated shearwall 10 of the present invention is the use of at least one thrust block 30 and an anchor rod assembly 32 to provide uplift resistance in the shear force transfer region 28. For example, according to the embodiment shown in FIG. 1, forces originating at the top of the shearwall and causing uplift forces at the bottom corners may be carried via the anchor rod assembly 32 and accompanying rod 33, upward to adjoining thrust blocks 30. These forces may then be further distributed directly or indirectly to any of the adjoining horizontal dividing member 24, vertical members 12, and diagonal framing members 40. Detrimental bending moments created between each anchor rod assembly 32 and its adjacent vertical member 12, are resisted by the thrust block 30, the adjoining horizontal dividing member 24, and the vertical members 12, and the diagonal framing members 40.

According to the structural relationships in FIG. 1, the thrust blocks 30 have edges that abut one of the horizontal dividing member 24, a vertical member 12, or both. Furthermore, the thrust blocks 30 are spaced vertically apart from the lower horizontal member 22, or base of the shearwall. The term "abutting" describes the situation where the planar faces of the adjoining surfaces are directly opposed or face one another. In a preferred embodiment, "abutting" refers to opposing surfaces that contact each other. In the embodiment shown in FIG. 1, thrust blocks 30 are supported below at either end of the horizontal dividing member 24 and abut it as well as the vertical member 12 and diagonal framing members 40 proximate the thrust block 30. Penetrating at least partly, and preferably completely, through each of these thrust blocks 30 is an anchor rod assembly 32 comprising a rod 33 that extends downward in the shear force transfer region 28 adjacent to the lower ends 16 of the vertical members 12. The rod 33 generally extends substantially parallel to the vertical members 12 of the shearwall 10.

Each anchor rod assembly 32 includes a rod 33 that can further include a connector 36 for securing the rod 33 to a foundation anchor 34. The connector 36 can include an internally or externally threaded end of rod 33, a turnbuckle, or a coupler. The anchor rod assembly 32 may be such that the rod length can be adjusted (e.g., using a threaded junction such as the connector 36) to ensure proper coupling with one of the foundation anchors 34. The lower portions of these anchor rod assemblies 32, in a preferred embodiment, are adapted for connection to foundation anchors 34. Therefore, in this embodiment, the anchor rod assemblies 32 advantageously extend substantially to the lower horizontal member 22. As shown in FIG. 1, the connection between the anchor rod assemblies 32 and foundation anchors 34 is accomplished with connectors 36, that are received by respective threaded ends of the anchor rod assemblies 32 and the foundation anchors 34. However, such connections can be achieved in any conventional manner, for example welding, in which case no special fitting or adaptor would be required. The use of other conventional fittings, including turnbuckles, couplers, hooks, latches, clamps, etc. may also be employed to effect this connection, as previously mentioned. The adaptation of the anchor rod assemblies 32 to foundation anchors will therefore involve the use of a connective lower end, preferably threaded, of the anchor rod assemblies 32. Of course, the lengths of the rods 33 themselves can be such that they extend to near the bottom of the shearwall 10, or they may be of a substantially shorter length, depending on the length of the foundation anchors 34 to which they connect. In one embodiment, the foundation anchor "pins" 34 can extend upward through the thrust blocks 30 and be secured thereto, such that anchor rod assemblies 32 and rods 33 include the foundation anchors (pins) 34.

Conveniently, the rod 33 may be cylindrically shaped, but it may also have a dimensional cross section (e.g., a rectangle) without detracting from its intended purpose of distributing shear stresses and bending moments away from the most vulnerable areas (e.g., the bottom corners) of the shearwall 10. One mode of stress diffusion is from the anchor rod assembly 32 to an adjoining thrust block 30. In turn, the thrust block 30, by virtue of its direct or indirect attachment (e.g., using intermediate connecting structures, such as the thrust block connector plate 47) to the horizontal dividing member 24, a vertical member 12, a diagonal framing member 40, or all three can further transfer stresses from the bottom of the shearwall 10 to these less vulnerable structures.

FIG. 1 shows a preferred embodiment where the rods 33, which comprise a part of each anchor rod assembly 32 extend completely through, and are secured at the top face of the thrust blocks 30, using, for example, bolted connections. However, any conventional connection can be used. In a preferred embodiment, the rods 33 extend at least partially through the thrust blocks 30. In any case, the thrust blocks 30 are used to position the anchor rod assemblies 32 in an upright position so that they run substantially parallel to, and adjacent or proximate, at least a portion of the vertical members 12, as shown in FIG. 1. In order to provide exceptional properties of the shearwall 10 in terms of strength and stiffness in the lower shear force transfer region 28, the anchor rod assemblies 32, in one preferred embodiment, comprise steel.

In FIG. 1, an overall uplift force resisting system, comprising the thrust blocks 30, provides the distribution of horizontal forces emanating from the top of the shearwall 10 that have been transferred to the top of the anchor rod assemblies 32 via rods 33. In terms of the positioning of the thrust blocks 30, FIG. 1 shows a preferred embodiment where the two thrust blocks 30, comprising a single or a plurality of individual boards, are secured directly beside the horizontal dividing member 24 and each have sides that abut the horizontal dividing member 24, the diagonal framing member 40, and one of the vertical members 12.

Furthermore, as shown in FIG. 1, the uplift force resisting system can include the thrust block connector plates 47 that improve the integrity of the junction between the thrust blocks 30 and adjoining structures, and also serve as a force-transferring structure to further improve the overall ability of the shearwall to diffuse localized stresses among its various parts. These connector plates 47 provide even more expansive distribution, in this preferred embodiment, of upward or downward forces, directed additionally to the vertical members 12 to which the thrust block connector plates 47 are attached, compared to the prior art. Overall, the thrust blocks 30 and thrust block connector plates 47 act together to prevent failure of the connection between the horizontal dividing member 24, the diagonal framing members 40, and the vertical members 12 by moving stresses from uplift forces and transferring them to the anchor rod assembly 32. The thrust block connector plates 47 can be used with various types of connections, for example nails, screws, bolts, brackets, clips, staples, glued connections, or connections formed using wood joints, threaded fittings, or grooved or slotted fittings.

Another benefit of the thrust block 30 and anchor rod assemblies 32 used in the shearwall of the present invention relates to the elimination of eccentricities created in conventional shearwalls between the vertical members 12 and points of connection to the foundation. In contrast to conventional shearwalls, the use of thrust blocks 30 and anchor rod assemblies 32, which extend parallel to the vertical members 12, overcomes the detrimental effects of the eccentricities described previously with respect to conventional hold-down hardware by eliminating it entirely. Instead, the anchor rod assemblies 32, by extending alongside the lower ends 16 of the vertical members 12 to the thrust blocks 30, act in a manner to stiffen and reinforce the lower ends 16 of the vertical members 12 and thereby vastly reduce the effects of eccentricities resulting from anchoring to the foundation. More specifically, the connection of these force carrying anchor rod assemblies 32 to the vertical members 12 by thrust blocks 30 and connector plates 47, essentially or substantially realigns and distributes stresses to the vertical members 12, the horizontal dividing member 24, and diagonal framing member 40, thereby reducing stresses on the hold-down hardware. The embodiment shown in FIG. 1, where the thrust blocks 30 extend above the horizontal dividing member 24, effectively lengthens the rod 33, when it is secured to the top of a thrust block 30, to an additional height above the horizontal member 24, namely the height of the thrust block 30. This added height allows for the transfer of failure-causing stresses from, for example, the bottom corners of the shearwall 10, to directly along a greater length of the vertical members 12. Thus, the known problems with prior art shearwalls associated with the necessary offset between the points of connection of traditional hold-down hardware and the vertical members is effectively eliminated using the thrust block 30 and anchor rod assemblies 32 of the present invention.

The shearwall 10 also includes wrap-around connector plates 44 that cover at least a portion of the bottom surfaces 18 of the vertical members 12. In the preferred case where the vertical members 12 comprise dimensional lumber, the wraparound connector plates 44 can be typically characterized as "3-sided" connector plates that cover not only the bottom surfaces 18, but also a portion of two exterior sides of the lower ends 16 of each vertical member 12. These wrap-around connector plates 44 protect against slippage between themselves and the vertical members 12 that they secure. The wrap-around connector plates 44 have shown to reduce separation of the vertical members 12 and the lower horizontal member 22 or base at their respective junctions when an uplift force is applied. In the opposite case, when a downward or compressive force is applied, the wrap-around connector plates 44, by virtue of covering at least a portion of the bottom surface of the vertical members, act as bearing enhancers to distribute stress loads over a wider surface area.

Also shown in FIG. 1 is a vertical dividing member 46 that extends between the upper horizontal member 20 and the lower horizontal member 22 and is secured to these horizontal members 20, 22 at approximately their midpoints. As shown, the vertical dividing member 46 need not be a continuous structure, but may be interrupted between the horizontal members 20, 22 by the horizontal dividing member 24. In this case, joining the parts of the vertical dividing member 46 to the horizontal dividing member 24 can be done in any convention matter, for example using nails, screws, bolts, brackets, clips, staples, glue, or using wood joints, threaded fittings, or grooved or slotted fittings. The vertical dividing member 46 can be dimensional lumber, metal, plastic, ceramic, or a like material capable of being secured within the frame of the shearwall 10 and having a rigid structure. The vertical dividing member 46 may be solid, hollow, or filled with a material such as concrete. Some alternative embodiments may not include this dividing member 46, although additional overall wall strength advantages are gained from its use.

Overall, the vertical members 12, horizontal members 20, 22, dividing member 24, diagonal framing members 40, thrust blocks 30, and optionally the vertical dividing member 46 that form part of the shearwall 10 all preferably comprise dimensional lumber. The dimensional lumber most widely available and therefore preferred for the shearwall design is known in the art as "2 by" lumber. One common example of such lumber is known as "2 by 4" lumber having two of its dimensions, namely the width and thickness, set at about 1½ inches and about 3½ inches, respectively. This represents a preferred framing material for the shearwall of the present invention. Also preferred for the present invention, is the use of metal plates 48 to secure any of the junctions involving the vertical members 12, horizontal members 20, 22 dividing member 24, and diagonal framing member 40 of the shearwall 10. These metal plates 48 may be secured, for example, by being nailed or pressed into the these members at their respective junctions. The size, species, and grade of lumber, and the size and gauge of the metal plates 48, if used, can be varied to meet the desired strength and stiffness objectives for a specific shearwall. These metal plates 48 are used in addition to the thrust block connector plates 47 and wrap-around connector plates 44.

Preferred dimensions for the shearwall 10, as determined from its most relevant applications in the construction industry, are a width ranging from about 1 to about 8 feet and a height ranging from about 5 to about 10 feet. However, other sizes can be formed. The shearwall can be prefabricated in a variety of sizes to suit various building design requirements. As shown in FIG. 1, the shearwall 10 may include additional elements, such as anchor bolts 54 to help stabilize the shearwall 10 with respect to the foundation.

Figure 2:
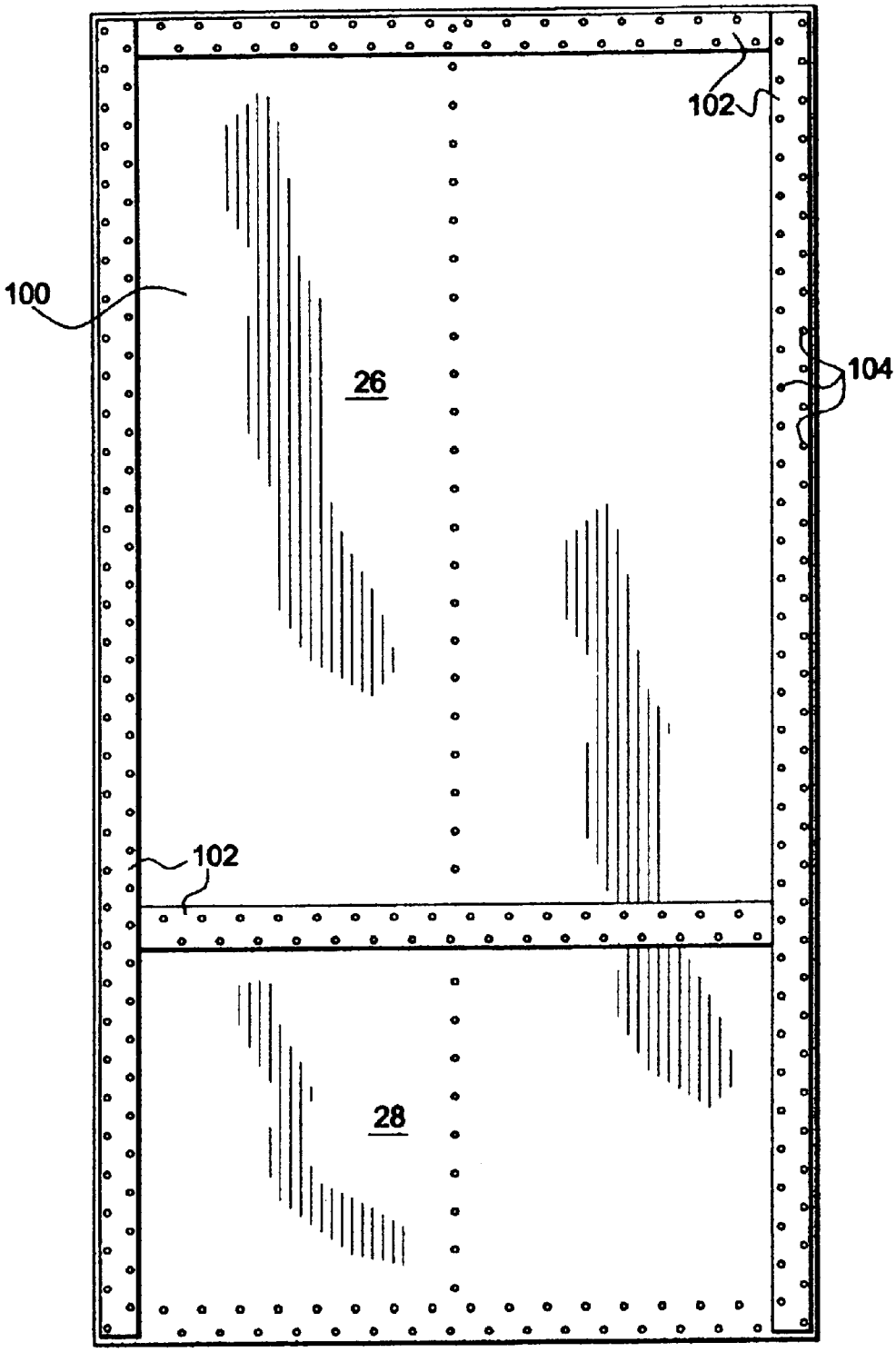
FIG. 2 is another front view, but illustrating the use of sheathing material and steel reinforcing straps, secured by nails to the shearwall at its front face.

FIG. 2 depicts the shearwall of FIG. 1, but with its front face covered with optionally a sheathing material 100, so that main components described in FIG. 1, namely the vertical and horizontal members, thrust blocks, anchor rod assemblies, and wrap-around connector plates, are not in view in FIG. 2. Thus, the sheathing material 100 traverses the planar surface defined, in this case, by the front face of the rectangular prism defined by the vertical and horizontal members. The sheathing material 100 covers both the energy dissipation 26 and shear force transfer 28 regions and preferably comprises plywood or OSB that is attached to any or all of the vertical and horizontal framing members preferably using sheathing nails 104.

Also shown in FIG. 2, when sheathing material is used, reinforcing straps 102, preferably made of light gauge steel, are fastened, using a predetermined nailing pattern, to sections of the vertical and horizontal members in locations where stresses known to promote nail fatigue are most concentrated. The nailing pattern, characterized by offset rows of nails directed into the vertical, horizontal, and horizontal dividing members, provides a desired combination of strength of the connection between the sheathing material and members, along with efficiency of nail usage. These reinforcing straps 102 have substantially flat, planar faces secured to, and abutting, the sheathing material 100. The shear capacity of the sheathing nails 104 is significantly increased when driven through the steel reinforcing straps 102, the sheathing 100, optional reinforcing connector plate pressed into the vertical and horizontal members (not shown in FIG. 2), and the wood members themselves (not shown in FIG. 2).

Preferably, in order to maximize the benefit of the reinforcing straps 102 in terms of their ability to redistribute stresses on the sheathing nails 104, the reinforcing straps 102 will abut the sheathing material 100 in areas overlapping, or coextensive with, the upper horizontal member and vertical members, as well as areas overlapping the dividing member and vertical members. Such an arrangement is shown in FIG. 2. By overlapping or coextensive areas it is meant that these areas coincide with one another but may not necessarily be directly adjoining surfaces, as in the case where flat surface, for example the sheathing material 100 intervenes between two other surfaces, for example the reinforcing straps 102 and vertical members (not shown in FIG. 2).

It is preferable that the reinforcing straps 102 comprise light gauge steel, as this material offers a high tensile strength relative to its weight, when compared to other candidate materials for this application. The length and width of the reinforcing straps 102 may vary but these dimensions will normally depend on those of the members that they overlap. Since the vertical and horizontal members (not shown in FIG. 2) typically will comprise "2 by" dimensional lumber, it is preferable that the reinforcing straps have a width of about two inches.

In the shearwall design of the present invention, the reinforcing straps 102 limit the localized deformation of plywood or OSB sheathing, as well as deformation of the dimensional wood members. The reinforcing straps 102 also distribute shear stresses in the sheathing nails 104 from the most highly stressed nails at the upper corners of the energy dissipation region of the shearwall to lower-stressed nails located away from these corners. This more favorable distribution of stresses has been found to result in an overall improvement in nail performance, by effectively eliminating the typical nail fatigue failures observed in conventionally framed shear walls. In combination with the reinforcing straps 102, the sheathing nails 104 may be varied in terms of their size, gauge, and spacing in order to meet the desired strength and stiffness objectives.

Figure 3:
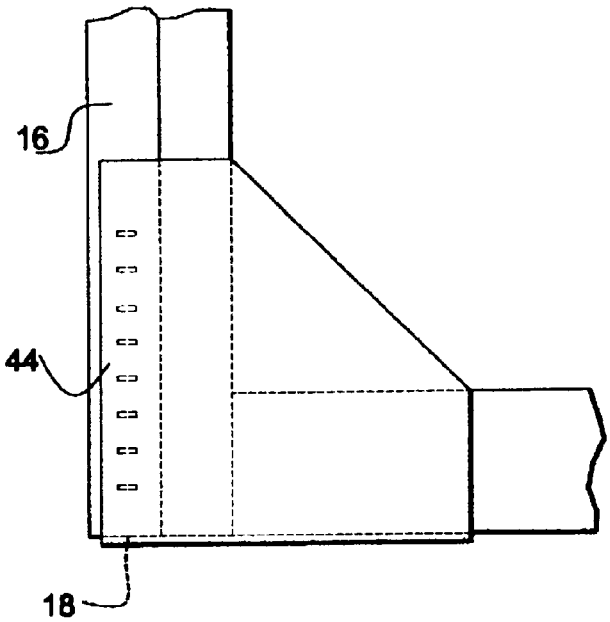
FIG. 3 is an exploded front view showing a 3-sided connector plate of the present invention, used to connect the bottom section of a supporting vertical end post to a lower horizontal member or base plate.
Figure 4:
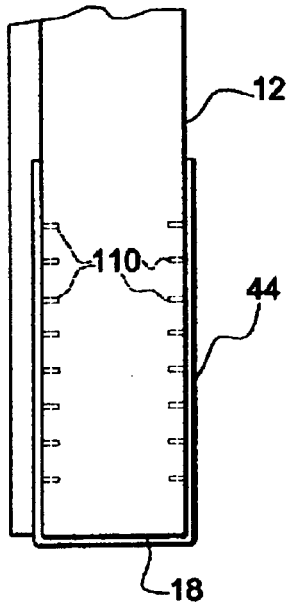
FIG. 4 is an exploded side view of the section in FIG. 3, showing the use of teeth bent out from the 3-sided connector plate to secure it to the vertical end post.
Figure 5:
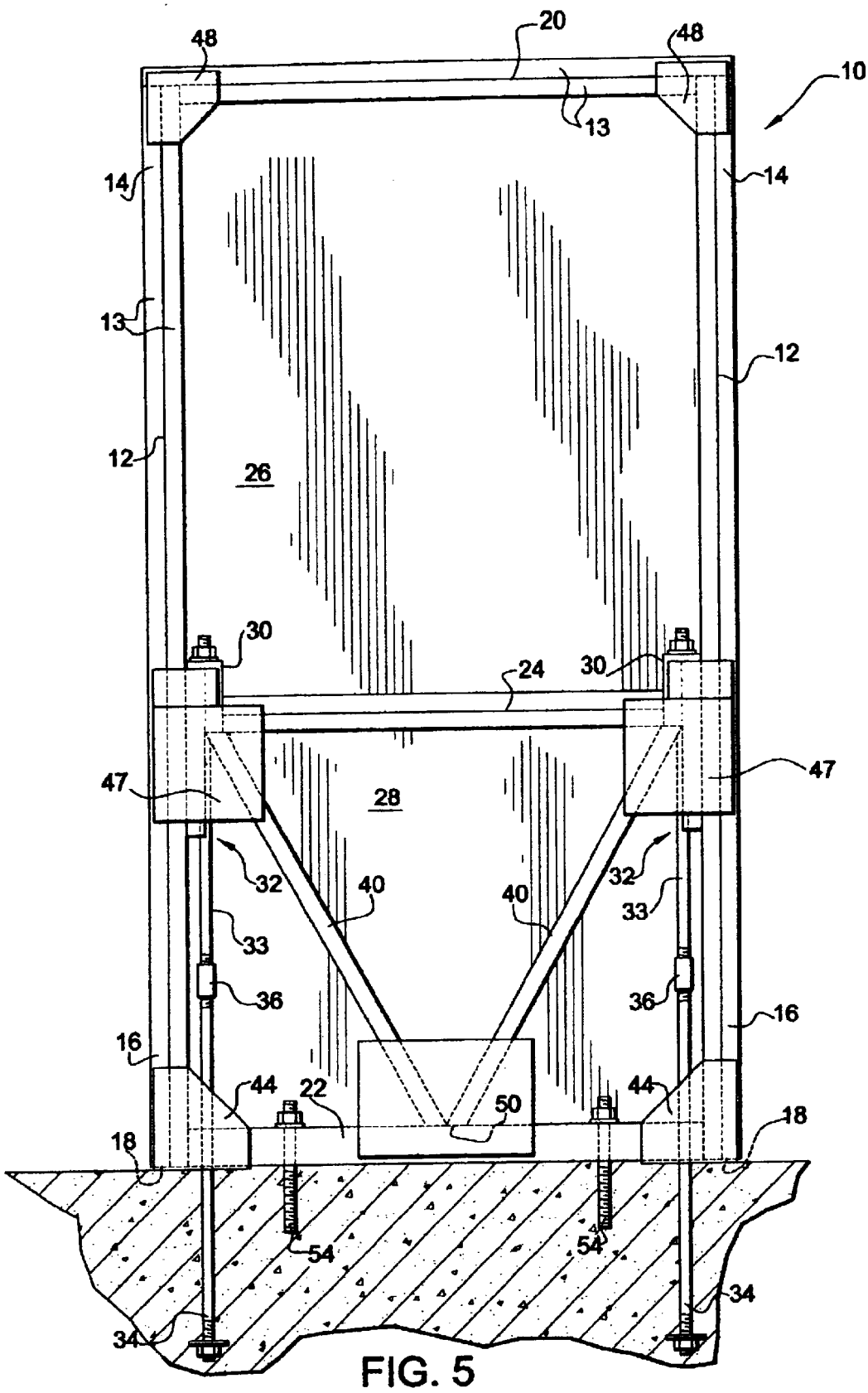
FIG. 5 depicts another embodiment of the invention, without a vertical dividing member, and having a lower horizontal member and diagonal framing members comprising a single board.
Figure 6:
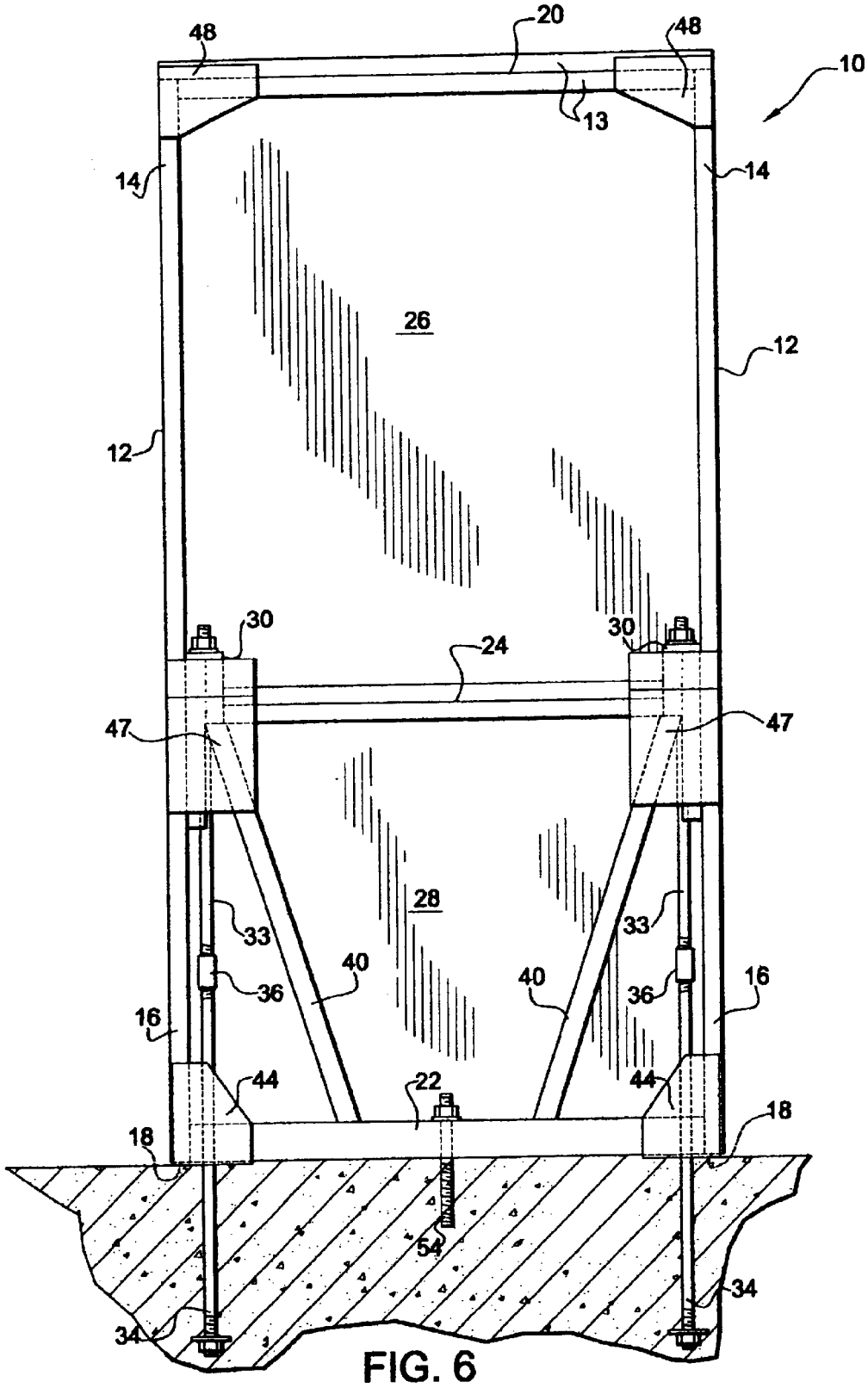
FIG. 6 depicts a yet another embodiment of the invention, where the diagonal framing members are connected to the lower horizontal member at different locations.

As shown in detail in FIG. 3, a typical wrap-around connector plate 44 connects the adjoining vertical member 12 to the horizontal member 22. In this particular embodiment, the bottom side of the wrap-around connector plate 44 shown has a hole that allows passage of a foundation anchor 34, which is connected to the rod 33 using the threaded coupler 36. As illustrated in the side view of FIG. 4, the wrap-around connector plate 44 covers at least two sides of the exterior surface of the vertical member 12 to which it is secured, in addition to the bottom surface 18 of the vertical member 12 and horizontal member 22. Generally, the wrap-around connector plate 44 covers at least a portion of this exterior surface in addition to covering at least a portion of the bottom surface 18. The wrap-around connector plate 44 could also cover all or substantially all of the bottom surface 18. In a preferred embodiment, as is illustrated in FIG. 4, the wrap-around connector plate 44 is secured to the exterior surfaces of the vertical member 12 using a plurality of teeth 110 bent out from the wrap-around connector plates 44. These teeth 110 are most conveniently formed when the wrap-around connector plate 44 comprises metal. The teeth 110 may assume any of a number of possible geometries and may be oriented vertically or horizontally. Preferably, the bottom side of the wrap-around connector plate 44 covering the bottom surface 18 of the vertical member 12 will not have teeth.

The wrap-around connector plate 44 of the present invention serves at least two purposes, with respect to the direction of the stress applied to the upper portion of the shearwall. The forces resisted in the vertical members 12 alternate between tension and compression as the direction of the lateral load at the top of the shearwall alternates during cyclic loading. Tests show that during the tension, or uplift, phase of the cyclic test, there is a tendency for the vertical member 12 to slip relative to the connector plate if conventional two-sided connector plates are used. The wrap-around connector plate 44, however, covers at least a portion of the bottom surface 18 of the vertical member 12 and lower horizontal member 22 that it secures, thereby ensuring that the relative movements among this wrap-around connector plate 44, the vertical member 12, and the lower horizontal member 22 are greatly reduced. During the compression phase of the cyclic test, the bottom side of the wrap-around connector plate 44, covering a portion of the bottom surfaces 18 of the vertical member 12 and horizontal member 22, acts as a bearing enhancer to distribute the applied compression loads to a larger area. This effect reduces the bearing stresses on the vertical members 12 as well as on the foundation. Thus, the wrap-around connector plate 44 of the present invention results in significantly higher lateral load capacities compared to conventional shearwalls.

While these particular embodiments of the invention have been shown and described, it is recognized the various modifications thereof will occur to those skilled in the art. Therefore, the scope of the herein-described invention shall be limited solely by the claims appended hereto.

What is claimed is:

1. A shearwall having improved resistance to lateral loads and variable stiffness alone its height, the shearwall comprising:

a) a first and a second supporting vertical member for supporting the shearwall in an upright position;

b) a base attached to the supporting vertical members, where the base and supporting vertical members define an area within a frame;

c) a horizontal dividing structure that, when the shearwall is supported in an upright position, extends substantially horizontally between each of the supporting vertical members, whereby the horizontal dividing structure divides the area within the frame into a larger upper region and a smaller lower region;

d) a frame support structure extending between the horizontal dividing structure and the base for transferring shear forces to the foundation, wherein the frame support structure comprises at least one diagonal framing member attached to the base and extending at an angle between the base and one of the first and second supporting vertical members, the horizontal dividing member, or both; and e) a first thrust block spaced vertically apart from the base and abutting at least one of the first supporting vertical member, the horizontal dividing structure, and the diagonal framing member, and a second thrust block spaced vertically apart from the base and abutting at least one of the second supporting vertical member, the horizontal dividing structure, and the diagonal framing member;

where the first thrust block is attached to the first supporting vertical member and the horizontal dividing structure using a first thrust block connector plate and the second thrust block is attached to the second supporting vertical member, the horizontal dividing structure, and the diagonal framing member using a second thrust block connector plate.

2. The shearwall of claim 1 further comprising a first anchor rod assembly for transferring uplift forces from the base to at least one of the first thrust block and first supporting vertical member, where the first anchor rod assembly extends between the first thrust block and the base, and further extends at least partially through the first thrust block.

3. The shearwall of claim 2 where the first anchor rod assembly extends substantially parallel to and proximate the first supporting vertical member.

4. The shearwall of claim 2 further comprising a second anchor rod assembly for transferring uplift forces from the base to at least one of the second thrust block and second supporting vertical member, where the second anchor rod assembly extends between the second thrust block and the base, and further extends at least partially through the second thrust block.

5. The shearwall of claim 4 where the second anchor rod assembly extends substantially parallel to and proximate the second supporting vertical member.

6. The shearwall of claim 4 where the first and second anchor rod assemblies are each adapted at their respective lower ends for coupling with a foundation anchor.

7. The shearwall of claim 5 where the first and second anchor rod assemblies are each adapted at their respective lower ends using a threaded fitting.

8. The shearwall of claim 5 where the first and second anchor rod assemblies comprise metal.

9. A shearwall having improved resistance to lateral loads and variable stiffness along its height, the shearwall comprising:

a) a first and a second supporting vertical member for supporting the shearwall in an upright position;

b) a base attached to the supporting vertical members, where the base and supporting vertical members define an area within a frame;

c) an uplift force resisting system for distributing uplift forces from the base to at least one of the supporting vertical members, the uplift force resisting system extending along the length of, and proximate, at least a portion of at least one of the supporting vertical members, wherein the uplift force resisting system comprises (i) a first thrust block spaced vertically apart from the base and abutting the first supporting vertical member, (ii) a first anchor rod assembly extending upwardly from the base to the top of the first thrust block, and (iii) a second thrust block spaced vertically apart from the base and abutting at least one of the second supporting vertical member, the horizontal dividing structure, and the diagonal framing member;

d) a structural member that, when the shearwall is supported in an upright position, extends substantially horizontally between an upper end of the first and second supporting vertical members, where the first and second supporting vertical members, the base, and the structural member are attached to substantially form the frame such that the area within the frame is rectangular;

e) a horizontal dividing structure that, when the shearwall is supported in an upright position, extends substantially horizontally between each of the supporting vertical members, whereby the horizontal dividing structure divides the area within the frame into a larger upper region and a smaller lower region; and f) a frame support structure extending between the horizontal dividing structure and the base for transferring shear forces to the foundation, wherein the frame support structure comprises at least one diagonal framing member attached to the base and extending at an angle between the base and one of the first and second supporting vertical members, the horizontal dividing member, or both where the first thrust block is attached to the first supporting vertical member and the horizontal dividing structure using a first thrust block connector plate and the second thrust block is attached to the second supporting vertical member and the horizontal dividing structure using a second thrust block connector plate.

10. The shearwall of claim 9 where the first anchor rod assembly extends substantially parallel to and proximate the first supporting vertical member.

11. The shearwall of claim 9 where the uplift force resisting system further comprises a second anchor rod assembly extending to the top of the second thrust block.

12. The shearwall of claim 11 where the second anchor rod assembly extends substantially parallel to and proximate the second supporting vertical member.

13. The shearwall of claim 11 where the first and second anchor rod assemblies are each adapted at their respective lower ends for coupling with a foundation anchor.

14. The shearwall of claim 13 where the first and second anchor rod assemblies are each adapted at their respective lower ends using a threaded fitting.

15. The shearwall of claim 13 where the first and second anchor rod assemblies comprise metal.

16. The shearwall of claim 9 further comprising an OSB or plywood sheathing material traversing at least one of a front and a back surface of the frame, wherein the sheathing material is attached to at least one of the uplift force resisting system and the supporting vertical members.

17. The shearwall of claim 16 further comprising a plurality of reinforcing straps abutting the sheathing material and coextensive with at least a portion of at least one of the supporting vertical members in areas of localized stress concentrations.

18. The shearwall of claim 9 if wherein the supporting vertical members and base comprise dimensional lumber.

19. The shearwall of claim 9 further comprising first and second wrap-around connector plates covering, and attached to, at least a portion of the exterior surface of the first and second supporting vertical members, respectively, and having bottom sides covering at least a portion of the bottom surfaces of the first and second supporting vertical members, respectively, and the base.

20. The shearwall of claim 9 wherein the supporting vertical members and the horizontal structural member are attached at their respective junctions using metal connector plates.

21. The shearwall of claim 9 where the height that the horizontal dividing structure extends between each of the supporting vertical members is from about one tenth to less than ½ of the height of the shearwall.

22. The shearwall of claim 9 where the height that the horizontal dividing structure extends between each of the supporting vertical members is at a height of about ⅓ of the height of the shearwall, and thereby divides the area within the frame into upper and lower regions, with the cross sectional area of the upper region being about twice that of the lower region.

23. The shearwall of claim 9 where the first anchor rod assembly extends substantially parallel to and proximate the first supporting vertical member.

24. The shearwall of claim 9 where the uplift force resisting system further comprises a second anchor rod assembly for transferring uplift forces from the base to at least one of the second thrust block and second supporting vertical member, where the second anchor rod assembly extends between the second thrust block and the base and further extends at least partially through the second thrust block.

25. The shearwall of claim 24 where the second anchor rod assembly extends substantially parallel to and proximate the second supporting vertical member.

26. The shearwall of claim 24 where the first and second anchor rod assemblies are each adapted at their respective lower ends for coupling with a foundation anchor.

27. The shearwall of claim 26, where the first and second anchor rod assemblies are each adapted at their respective lower ends using a threaded fitting.

28. The shearwall of claim 27 where the first and second anchor rod assemblies comprise metal.

* * * * *